US005289743A

United States Patent [19]

Cirami

[11] Patent Number: 5,289,743

[45] Date of Patent: Mar. 1, 1994

[54] TWO-SPEED REDUCTION GEARED SCREWDRIVER

[76] Inventor: Salvatore Cirami, 12-21 35th Ave., Apt. 4F, Long Island City, N.Y. 11106

[21] Appl. No.: 52,506

[22] Filed: Apr. 26, 1993

[51] Int. Cl.[5] ..... B25B 17/00

[52] U.S. Cl. ..... 81/57.31; 81/34

[58] Field of Search ..... 81/28, 34, 57.3, 57.31, 81/57.14

[56] References Cited

U.S. PATENT DOCUMENTS

| | | | |
|---|---|---|---|
| 919,156 | 4/1909 | Gilmore | 81/34 |
| 2,721,591 | 10/1955 | Criswell | 81/28 |
| 2,979,089 | 4/1961 | Piesker | 81/57.31 |
| 3,580,097 | 5/1971 | Van Dalen | 81/34 X |
| 3,992,964 | 11/1976 | Osmond | 81/57.31 |
| 4,048,874 | 9/1977 | Riches | 81/57.31 |
| 4,448,098 | 5/1984 | Totsu | 81/57.31 X |
| 4,846,027 | 7/1989 | Lu | 81/57.3 |
| 5,009,132 | 4/1991 | Gilberto | 81/57.3 |
| 5,033,336 | 7/1991 | Chia-Tsai | 81/57.3 |

*Primary Examiner*—James G. Smith

[57] ABSTRACT

A one-piece handle member provided with a bore and a tubular pinion gear fixed to and projecting from a forward end of the handle coaxially with the bore is rotatably mounted on the rearward portion of a single drive shaft against a driven gear fixed coaxially to an intermediate portion of the shaft. A lug member fixed to the intermediate portion of the shaft on the other side of the driven gear projects laterally therefrom and supports a pivot spaced parallel to the drive shaft. First and second transfer gears connected for rotation together are rotatably mounted on the pivot with the first transfer gear permanently meshed with the pinion gear and the second transfer gear permanently meshed with the driven gear. A planar lock member slidably mounted in a slot extending cross-sectionally through the handle has exposed ends used to position the lock member relative to a shaft segment passing through the lock member. In one position the lock member locks the handle to the shaft whereby the shaft turns with the same torque as the handle. In another position the lock member frees the handle for rotation relative to the shaft whereby the gears rotate the shaft a lesser number of degrees than the handle with correspondingly increased torque. A cylindrical retaining ring rotatably secures the shaft to the handle by jamming inside the bore of the handle. In one embodiment a forward portion of the shaft engages the screw; another utilizes detachable screwdriver bits.

10 Claims, 2 Drawing Sheets

TWO-SPEED REDUCTION GEARED SCREWDRIVER

BACKGROUND

1. Field of the Invention

This invention pertains to an improved screwdriver having a single drive shaft rotatably mounted in a one-piece handle member, reduction gearing arranged therebetween, and lock means mounted in the handle member; the lock means being operable, in one position, to lock the handle member to the drive shaft whereby the reduction gearing is bypassed for operation like a conventional screwdriver, and in another position, to permit rotation of the handle member relative to the drive shaft whereby the reduction gearing is operable to increase the torque applied to a screw being turned.

2. Description of Prior Art

A screwdriver, in most common form, comprises a single drive shaft a rearward portion of which is rigidly fixed to a one-piece solid plastic handle and a forward portion of which is shaped to engage a slot-head, philips-head or other type of screw. In another form, the forward portion of the drive shaft is adapted to detachably engage alternative screwdriver bits which differ according to the type of screw head that is to be turned. In either embodiment, the drive shaft turns the same number of degrees as the handle and so the amount of torque that can be applied to the screw is limited according to the strength of the user.

When installing a woodscrew, depending upon the length and diameter of the screw, the hardness of the wood and the size of a pilot hole, if any, substantially increased resistance may be experienced during the last few turns of the screw or during the first few turns when removing such screw. Unexpected resistance may also be experienced when attempting to force a self-tapping screw through a pilot hole that is a little too small. Of course, even for woodscrews, one should provide a pilot hole of correct size, but oftentimes, even when it would seem one has done so, significant resistance may be encountered. At such times, common practice is to grip the screwdriver handle as tightly as possible and force it to turn. This is quickly tiring and even painful, depending upon the size of the screw and how many are being installed or removed. When it can be done without splitting the wood or, in the case of a self-tapping screw, without stripping the screw, a longer screwdriver can be used to apply greater turning force to the screw, but only a moderate mechanical advantage is gained thereby. Many households are fortunate to possess a single screwdriver, typically of medium size, let alone an assortment including an extra-long screwdriver. Even the well-equipped mechanic does not always have exactly the right screwdriver close at hand when needed.

There has long been need for a screwdriver that is adjustable to select an alternative operating mode whereby a greater torque can be applied to the screw than the user is applying to the handle; but, not costing significantly more than a conventional screwdriver, and, without loss of any of the advantages provided by a conventional screwdriver, such as simplicity for durability, compactness and lightness of weight for carrying on one's person or in a tool belt, and an unobstructed view of the screw being turned.

The nearest prior art known comprises U.S. Pat. Nos. 2,721,591, 3,992,964, 4,048,874. 4,846,027 and 5,033,336, which disclose screwdrivers and devices similar thereto wherein gearing is arranged between a handle and an output shaft in order to effect alternative drive ratios therebetween, but in every instance, the disclosed device comprises so many parts that a screwdriver so constructed would cost several times as much as a conventional screwdriver, the price of which determines what the consumer expects to pay for a screwdriver. No prior art is known to disclose a reduction geared screwdriver having such simplicity that it could be manufactured to sell at a price comparable to a conventional screwdriver; which may explain why one does not find reduction geared screwdrivers on display where hand tools are sold and the public has continued to be denied the benefit of such a screwdriver.

The referenced prior art is limited by comprising numerous components including one or more of the following: internally toothed gears cooperating with planetary gears, plural drive shafts or complex linkages ultimately defining a drive shaft, and a handle that either is disclosed as comprising more than one part, or, clearly could not be manufactured to incorporate lock means therein except by construction in plural parts. A further limitation characterizing the referenced prior art is that the reduction gearing is always supported by and concealed within an enclosing cylindrical housing (other than the handle) that, having a diameter greater than that of the handle, further obstructs (beyond that of the gearing itself) the user's view of the screw that is being turned. Reliance upon a housing to support the gearing leads to the further limitations of added weight and bulk, and, because frequently comprising plural parts, to added cost. In order to compete successfully against conventional screwdrivers, a reduction geared screwdriver must be characterized by comparable simplicity for comparable cost, compactness, ruggedness and lightness of weight.

U.S. Pat. No. 3,992,964, listed above and which is entitled "Torquing or Speeding Lug Wrench" is believed to be the closest approach of the prior art. It discloses what is therein termed a "gear box" in the form of a two-part cylindrical housing having parallel spaced apart first and second walls which close opposed ends of the assembled cylindrical housing. A first drive shaft is supported solely by and rotatably secured to the first wall, and a second drive shaft is supported solely by and rotatably secured to the second wall; the two shafts appearing as one because arranged end-to-end, but in fact being distinct members which are rotatable relative to each other. Either one of the shafts may serve as a handle (by connecting a detachable cross-bar thereto) when the other shaft is serving as an output or drive shaft (by connecting a detachable lug-engaging fitting thereto), depending upon whether the device is being used to turn a lug faster (the speeding mode) or to turn a lug with increased torque (the torquing mode). Alternative embodiments are disclosed, one of which, illustrated in FIG. 2 of such patent, shows four gears which are functionally related to each other in the manner of the invention disclosed herein, at least when used in the torquing (or reduction gear) mode. The arrangement disclosed in such patent cannot produce a reduction geared screwdriver comparable in cost and simplicity to a conventional screwdriver or having the other benefits sought to be provided. There are numerous differences, only three of which are pointed out here. First, two drive shafts are involved, instead of one drive shaft as in the present invention. Second, the two drive shafts are independently supported by and independently secured to the gear box; as opposed to the present invention wherein a single drive shaft is supported solely by and rotatably secured to a handle. Third, the use of two, independently rotatable drive shafts, requires that the gear box be held stationary (non-rotatable) during use of the device. For that purpose, the disclosure provides an "extension brace 16" fixed to and extending laterally from the one side of the gear box in order that the free end of such brace will abut the ground and thereby prevent rotation of the gear box when the shaft being used as the handle is being turned. Accordingly, the transfer gears, which are rotatably mounted within and supported by the gear box, have their pivotal axis held stationary with the gear box while a lug is being turned. The present invention provides its transfer gears rotatably mounted and exposed on a pivot that is fixed to the free end of a lug member that revolves with the drive shaft as the screw is being turned; this mode of support of the transfer gears gaining the advantage of minimally obstructing the user's view of the screw being turned, as well as reducing cost, bulk and weight.

SUMMARY OF THE INVENTION

An object of the invention is to provide, in one embodiment, a two-speed reduction geared screwdriver having a drive shaft that is adapted to engage the head of a screw for turning same; and to provide, in another embodiment, a two-speed reduction geared screwdriver handle device that is adapted to receive and is intended for use with detachable screwdriver bits.

With respect to both embodiments, an object of the invention is to provide each embodiment comprising a single drive shaft and a single one-piece solid plastic handle member having a closed rearward end, like a conventional screwdriver, but wherein the handle member is cast having a bore provided therein that is open at a forward end of the handle member and extends longitudinally therethrough but terminates short of the handle member's rearward end, a rearward portion of the drive shaft being rotatably secured in such solid handle member by means of a cylindrical retaining ring rotatably mounted in an annular indentation that is provided in a rearward end portion of the shaft, the retaining ring being inserted with the drive shaft into the handle member and obtaining a jammed fit inside the handle member's bore.

Another object is to provide such handle member cast having a tubular pinion gear partially embedded in the forward end of the handle member coaxially with the bore so that the pinion gear projects forwardly therefrom and is rotatable with the handle member about a common axis.

A further object is to provide a driven gear fixed coaxially to an intermediate portion of the drive shaft and to provide the described handle member rotatably mounted on the rearward portion of the drive shaft with the pinion gear adjacent the driven gear.

Further objects are to provide the drive shaft having a lug member fixed to the intermediate portion of the drive shaft adjacent the driven gear (on the side thereof opposite from where the pinion gear is) and projecting laterally therefrom; to provide the lug member having a free end to which a pivot member is fixed extending therefrom toward the forward end of the handle member parallel to the drive shaft and spaced apart from the driven gear and pinion gear; to provide first and second transfer gears connected to each other for rotation together about a common axis; to provide such transfer gears rotatably mounted on the pivot member, such that, the first transfer gear is permanently meshed with the pinion gear and the second transfer gear is permanently meshed with the driven gear.

As a result of such arrangement, the free end of the lug member and the transfer gears turn with and thereby travel a circular path about the drive shaft whenever a screw is being turned, and as a result, the user's view of the screw being turned is obstructed by the gearing only to the extent that the free end of the lug member and the first transfer gear project radially outwardly of the forward portion of the handle member; this being a further object of the invention.

A further object is to provide the four gears having pitch diameters such that a reduction gearing is effected whereby the drive shaft turns a lesser number of degrees than the handle member and the drive shaft thereby turns with greater torque than applies to the handle member; such reduction gearing being effective only when the handle member can be rotated relative to the drive shaft.

A further object is to provide lock means mounted in the handle member, which, when set in one position, locks the handle member to the drive shaft for use like a conventional screwdriver, and, when set in an alternate position frees the handle member for rotation relative to the drive whereby the reduction gearing is operative to increase torque, which lock means is in such form that it can be installed in such handle member even though such handle member is cast in one piece. This object being attained by casting the handle member provided with a slot extending cross-sectionally therethrough so the slot is open at opposite sides of the handle member, and providing a lock member frictionally slidably mounted in such slot, the lock member having opposed ends accessible at the open ends of the slot for grasping between thumb and forefinger for sliding the lock member alternately in opposite directions within the slot, a central portion of such lock member being adapted to selectively engage or disengage the drive shaft for locking the handle member to the drive shaft or permitting rotation of the handle member relative to the drive shaft, respectively.

Further objects are to provide such lock member in planar form so that it can economically be stamped from sheet metal; having its central portion provided with an orifice having a tab member projecting inwardly from one end of the orifice; to provide the drive shaft with a recess adapted to receive such tab member for locking the handle member to the drive shaft in one position of such planar lock member, the tab being withdrawn from such recess in an alternate position of the lock member; and wherein installation is effected by first positioning the lock member in the handle member's slot and then inserting the drive shaft (with the cylindrical retaining ring mounted thereon) through the tubular pinion gear and the lock member's orifice into the handle member's bore.

Finally, it is an object to provide such planar lock member frictionally secured in the slot by virtue of being resilient and having a slight bend provided therein between the opposed ends of the lock member, such that, by slightly flattening the lock member as it is pushed into the slot, the lock member is retained in slight compression between opposed wall surfaces of the slot and thereby tends to remain where positioned in the slot.

BRIEF DESCRIPTION OF THE DRAWINGS

FIG. 9 being a cross-sectional view through the forward portion of the handle member the same as FIG. 5 but now showing the planar lock member (as seen in FIG. 6) mounted in the slot and with the shaft segment shown in FIG. 8 now located within the lock member's orifice. More particularly, FIG. 9 shows the lock member in a position wherein its tab member is withdrawn from the recess whereby the handle member is rotatable relative to the drive shaft for increased torque mode of operation; and, FIG. 10 shows the lock member in a position wherein its tab member is located within the recess whereby the handle member is locked to the drive shaft for conventional mode of operation. Finally.

DESCRIPTION OF PREFERRED EMBODIMENTS

Figures 1, 2, 3, 4, 5, 6, 7, 8, 9, 10:
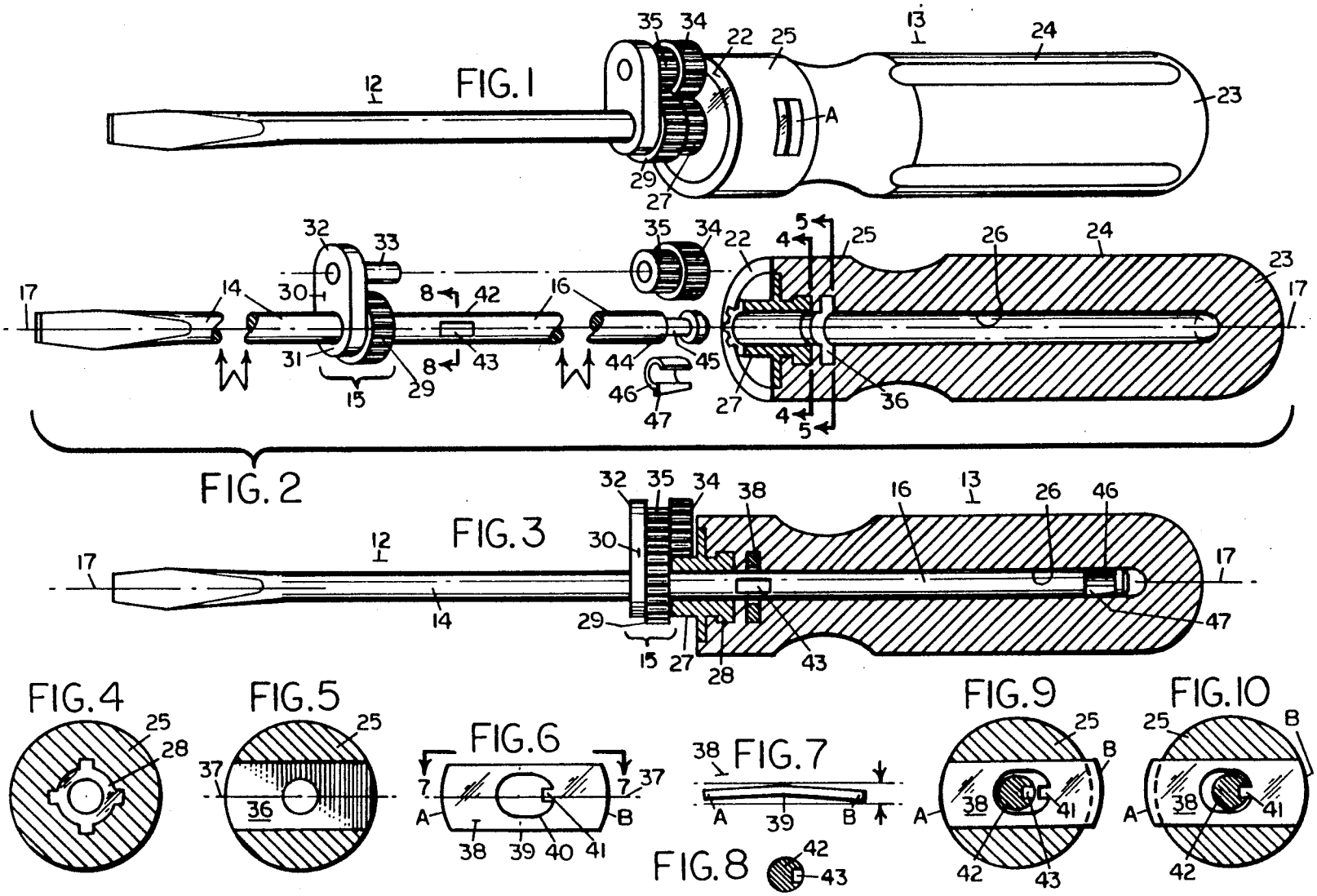
FIG. 1 is a general view in perspective of the invention two-speed reduction geared screwdriver showing an embodiment wherein the forward portion of the drive shaft has a free end adapted to engage a slot-head screw.
FIG. 2 is an exploded perspective view of the same with the drive shaft foreshortened and tubular pinion gear and the handle member in section and minus the planar lock member.
FIG. 3 is a side view of the structure of FIG. 2 in assembled relationship, partly in elevation and partly in section and including the planar lock member.
FIG. 4 is a cross-sectional view through the forward portion of the handle member taken on the plane 4—4 of FIG. 2, showing the embedded portion of the tubular pinion gear.
FIG. 5 is a cross-sectional view through the forward portion of the handle member taken on the plane 5—5 of FIG. 2, showing a slot extending cross-sectionally through and open at opposed outer surfaces of the forward portion of the handle member.
FIG. 6 shows the planar lock member, per se, as seen from its broad side (meaning, in the plane 5—5 of FIG. 2), showing its central portion provided with an orifice having a tab member projecting inwardly from one end of the orifice.
FIG. 7 again shows the planar lock member, per se, but as seen edgewise from the plane-7—7 of FIG. 6.
FIG. 8 is a cross-sectional view through the rearward portion of the drive shaft taken on the plane 8—8 of FIG. 2 showing a given segment of the drive shaft provided with a recess.
FIGS. 9 and 10 effectively combine FIGS. 5, 6 and 8.

Referring to FIG. 1 of the accompanying drawings, the invention provides a two-speed reduction geared screwdriver wherein a single drive shaft, indicated generally as 12 is rotatably mounted in a single handle member indicated generally as 13.

Referring to FIG. 2, the drive shaft 12 has a forward portion 14, an intermediate portion encompassed by the bracket 15, and a rearward portion 16, having a common longitudinal axis 17.

Figure 11:
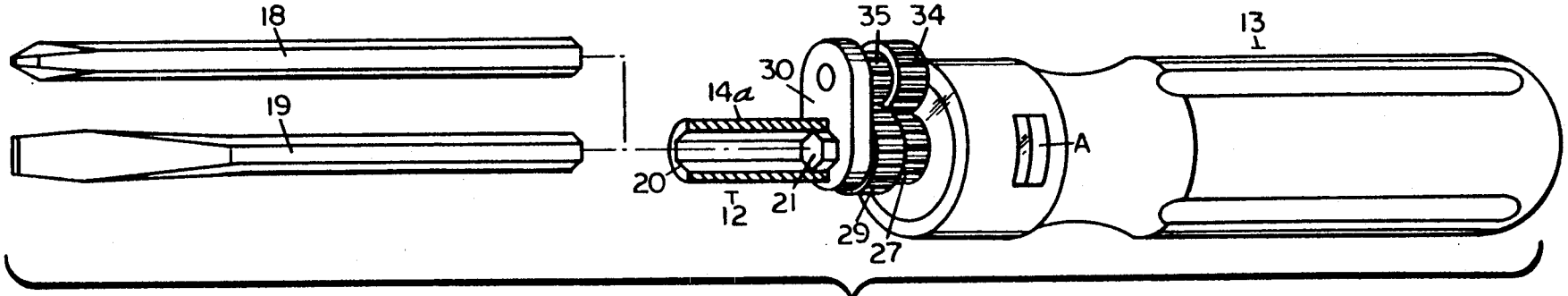
FIG. 11 is a perspective view of a fully assembled screwdriver handle device the structure of which is identical to that of the screwdriver shown in FIGS. 1-10 except that, in the FIG. 11 embodiment, the forward portion of the screwdriver shaft, which is shown in cross-section, is tubular and adapted to receive detachable screwdriver bits, an alternative two of which—one for a slot-head screw, the other for a philips-head screw—are shown in exploded relationship with respect to such handle device.

In this embodiment, the forward portion 14 of the drive shaft 12 is adapted to directly engage a screw, the forward portion 14 having a free end shaped to turn a slot-head screw. Of course it may be otherwise shaped for turning a philips-head or other type of screw. Alternatively, the forward portion 14 may be structured to receive detachable screwdriver bits. FIG. 11 illustrates an alternative forward portion 14(*a*) which is tubular for receipt of detachable screwdriver bits; e.g., a philips-head bit 18 or a slot-head bit 19. Conventionally, such detachable bits have a hexagonal shaft and are retained in the receiving tube by means of a permanent magnet that is fixed therein. The bits shown in FIG. 11 likewise have a hexagonal shaft and the forward portion 14(*a*) has a corresponding hexagonal interior wall 20 and has a permanent magnet 21 permanently fixed therein for retaining the bits 18, 19.

Referring to FIG. 2, the handle member 13 is economically formed in one piece as a solid, elongate, plastic casting, having a forward end 22, a rearward end 23, a rearward portion 24 adjacent the rearward end 23 suitable for grasping in the palm of one hand and a forward portion 25 adjacent the forward end 22 having opposed outer surfaces suitable for grasping between the thumb and forefinger of said hand.

The handle member 13 is cast having a bore 26 provided therein that is open at the forward end 22 of the handle member 13, extends inwardly therefrom toward but terminates short of the rearward end 23 of the handle member 13 so that the rearward end 23 is closed and solid like a conventional screwdriver, and having a tubular externally-toothed pinion gear 27 fixed to and projecting forwardly from the forward end 22 of the handle member 13 coaxial with the bore 26; such fixed attachment being economically attained by provision of the pinion gear inclusive of an attachment portion 28, FIGS. 3 and 4, that is embedded in the handle member 13 and is shaped such that the pinion gear 27 is rigidly fixed in position relative to the handle member 13. Accordingly, the pinion gear 27 and the handle member 13 are rotatable together about a common axis extending through the bore 26; when finally assembled, such common axis being the longitudinal axis 17.

Referring to FIG. 2, the handle member 13 and pinion gear 27 are rotatably mounted on the rearward portion 16 of the drive shaft 12 for rotation about the longitudinal axis 17, with the forward and intermediate portions 14, 15, respectively, of the drive shaft 12 projecting forwardly from the pinion gear 27.

An externally-toothed driven gear 29 is fixed (e.g., by welding) coaxially to the intermediate portion 15 of the drive shaft 12 adjacent (i.e., immediately forwardly of) the pinion gear 27. FIG. 3 shows the pinion gear 27 mounted directly against the driven gear 29 for greatest economy; optionally, a washer-like thrust bearing may be mounted therebetween.

A lug member, indicated generally as 30, has one end 31 fixed (e.g., by welding) to the intermediate portion 15 of the drive shaft 12 adjacent (i.e., immediately forwardly of) the driven gear 29. The lug member 30 extends laterally from the drive shaft 12 and has a free end 32, FIGS. 2 and 3, that projects radially outwardly of the driven gear 29 and the pinion gear 27.

A pivot member 33, FIG. 2, is fixed to the free end 32 of the lug member 30 and extends therefrom toward the forward end 22 of the handle member 13 parallel to the drive shaft 12 (i.e., parallel to the longitudinal axis 17) and spaced apart from the driven gear 29 and pinion gear 27.

Externally-toothed first and second transfer gears 34, 35, respectively, are fixed together for rotation about a common axis; the transfer gears 34, 35, preferably being economically forged or cast in one piece as represented in FIG. 2. Alternatively, they may comprise distinct gears which are welded together or they may remain distinct and merely be mechanically interlocked when finally assembled onto the pivot member 33. In any event the first and second transfer gears 34, 35, respectively, are rotatably mounted on the pivot member 33 with the first transfer gear 34 permanently meshed with the pinion gear 27 and the second transfer gear 35 permanently meshed with the driven gear 29 as shown best in FIG. 3. The transfer gears are economically retained on the pivot member 33 by the close proximity of the forward end 22 of the handle member 13 to the first transfer gear 34 which prevents the transfer gears from sliding axially off the pivot member 33 or significantly out of alignment with the gears cooperating therewith. Optionally, the pivot member 33 may be grooved and a retaining ring provided thereon.

The pinion gear 27, the first and second transfer gears 34, 35, respectively, and the driven gear 29 have respective pitch diameters defining reduction gearing arranged such that for each 360-degree rotation of the handle member 13 the drive shaft 12 is rotated less than 360 degrees.

The handle member 13 is cast having its forward portion 25 provided with a tubular slot 36, FIGS. 2 and 5, extending crosswise therethrough centered on a cross-sectional axis 37, FIG. 5, orthogonal to the longitudinal axis 17, FIG. 2; the slot 36 being open at opposed outer surfaces of the forward portion 25.

A planar lock member, indicated generally as 38, FIGS. 6 and 7, economically formed as a sheet metal stamping, is slidably mounted in the slot 36 as shown in FIGS. 9 and 10.

The lock member 38 is frictionally secured in the slot 36 so that the lock member 38 will tend to remain where positioned in the slot 36. A frictionally secured fit is econimically obtained by utilizing the resiliency inherent in the sheet metal from which the lock member 38 is stamped (the lock member 38 being suitably thin enough) by stamping the lock member 38 having its central portion 39 bent, as shown in FIG. 7 wherein the extension lines with opposed arrows thereon show that the opposed ends (A) and (B) of the lock member 38 are bent in the same direction away from the central portion 39, and by the slot 36 being proportioned such that the lock member 38 must be flattened slightly in order to fit it into the slot 36. Once forced into the slot 36, the lock member's central portion 39 pushes against one wall of the slot 36 and the ends (A) and (B) push against the opposite wall of the slot 36 whereby a frictionally secured fit is obtained.

The opposed ends (A) and (B) of the lock member 38, FIGS. 9 and 10, are accessible at the corresponding opposed outer surfaces of the handle member's forward portion 25 for grasping between thumb and forefinger in order to slide the lock member 38 alternately in opposite directions within the slot 36.

The stamping operation economically provides the lock member's central portion 39 with an orifice 40, FIG. 6, that permits the rearward portion 16 of the drive shaft 12 to be passed through the lock member 38, the orifice 40 being large enough—as measured along the cross-sectional axis 37—to permit the lock member 38 to be slid alternately in opposite directions within the slot 36, and is shaped to define a tab member 41 that projects inwardly from one end of the orifice 40.

The lock member 38 is installed in the handle member 13 by first sliding the lock member 38 into the slot 36 and then passing the rearward portion 16 of the drive shaft 12 through the pinion gear 27 and the orifice 40 into the bore 26. A given segment 42, FIG. 2, of the rearward portion 16 of the drive shaft 12, which segment 42 is provided with a recess 43, will then be located within the orifice 40. This is seen in FIG. 3 wherein the recess 43 is shown centered within the lock member 38.

The recess 43 is economically formed using a rotary milling tool which cuts an arcuate square-bottomed groove in the drive. FIG. 8 is a cross-section through the segment 42 taken on the plane 8—8 of FIG. 2, showing the recess 43 at its center; i.e., at the deepest point of the arcuate cut made by the rotary milling tool.

The lock member 38 is normally positioned as shown in FIG. 10 wherein the lock member end (A) protrudes outwardly of the handle member's forward portion 25. FIG. 1 shows the lock member end (A) in this normal use position and effectively forming a pushbutton. Referring back to FIG. 10, in this normal use position of the lock member 38, the tab member 41 is engaged with the recess 43 (pointed out in FIG. 9) in segment 42 of the drive shaft 12 whereby the handle member 13 is locked to the drive shaft 12 for fastest turning of a screw like a conventional screwdriver.

When a screw being turned significantly resists turning, the lock member end (A) is pushed inwardly to the position shown in FIG. 9, thereby withdrawing the tab member 41 from the recess 43 in segment 42 of the drive shaft 12. The handle member 13 will then be rotatable relative to the drive shaft 12 and the reduction gearing will then be operative to increase torque.

When the handle member 13, FIG. 3, is rotated, the pinion gear 27 necessarily rotates with the handle member 13. The pinion gear 27 rotates the first transfer gear 34, which, in the embodiment illustrated in the drawings, has a pitch diameter equal to that of the pinion gear 27, and, accordingly, in this embodiment, the first transfer gear 34 rotates at the same speed as the pinion gear 27. The second transfer gear 35, being fixed to the first transfer gear 34, necessarily rotates with it, but has a relatively smaller pitch diameter. The second transfer gear 35 turns the driven gear 29 which has a pitch diameter larger than that of the pinion gear 27. The drive shaft 12 therefore turns more slowly than the handle member 13, with correspondingly increased torque.

The gear reduction ratio may be increased by (i) decreasing the pitch diameter of the pinion gear 27 and correspondingly increasing the pitch diameter of the first transfer gear 34, or, (ii) further decreasing the pitch diameter of the second transfer gear 35 and correspondingly increasing the pitch diameter of the driven gear 29, or, doing both (i) and (ii).

Because the transfer gears are supported by the lug member 38 and are mounted exposed thereon (as opposed to being supported by and enclosed within a housing) the user's view of the screw being turned is obstructed only to the extent that the free end 32 of the lug member 38 and the first transfer gear 34 project radially outwardly of the forward portion 25 of the handle member 13. When a screw is being turned, such radially projecting portion travels a circular path around the drive shaft 12 and leaves the major portion of such path at any given time unobstructed, in contrast to a cylindrical housing which occupies the whole of such path at all times. A further advantage gained by exposure of the gears is that it enables the consumer at point of purchase to quickly appreciate the improvement offered and see for himself the mode of its operation.

The rearward portion 16 of the drive shaft 12 is rotatably secured in the solid one-piece handle member 13 in such a way that the handle member 13 has a smooth outside surface and a closed rearward end 23 like a conventional screwdriver. This is in contrast to prior art devices which resort to provision of an opening either in the rearward end or in the side of the handle for mounting structure for securing the drive shaft. As shown in FIG. 2, the rearward portion 16 of the drive shaft 12 has a rearward end portion 44 that is provided with an annular indentation 45. A cylindrical retaining ring 46 is provided defining a resiliently compressible open loop having an outwardly turned edge 47 that is adapted to jam in the bore 26. The retaining ring 46 is rotatably mounted in the indentation 45 with the edge 47 positioned facing toward the intermediate portion 15 of the drive shaft 12 and initially projecting outwardly of the indentation 45. The indentation 45 is deep enough to permit the retaining ring 46 to be compressed into (squeezed around) the indentation 45 during insertion of the rearward end portion 44 through the pinion gear 27 and lock member orifice 40 into the bore 26. FIG. 3 shows the retaining ring 46 in compression within the bore 26 and the edge 47 jammed in the bore 26 whereby the drive shaft 12 is rotatably secured in the handle member 13.

Finally, FIG. 11 illustrates a two-speed screwdriver handle device that, except for its drive shaft 12 having an alternative forward portion 14(*a*) for use with detachable screwdriver bits as described at the outset hereof, is identical in all respects to the structure described above.

I claim:

1. A two-speed reduction geared screwdriver, comprising:

a single drive shaft having a forward portion, an intermediate portion and a rearward portion having a common longitudinal axis;

said forward portion of said drive shaft having a free end adapted to engage the head of a screw for turning same;

a single handle member having opposed forward and rearward ends, said handle member provided with a bore open at the forward end of said handle member and extending inwardly therefrom toward the rearward end of said handle member;

a tubular externally-toothed pinion gear fixed to and projecting from the forward end of said handle member coaxial with said bore;

said handle member and pinion gear being rotatably mounted on the rearward portion of said drive shaft for rotation about said longitudinal axis with the forward and intermediate portions of said drive shaft projecting from said pinion gear;

means rotatably securing the rearward portion of said drive shaft in said handle member;

an externally-toothed driven gear fixed coaxially to the intermediate portion of said drive shaft adjacent said pinion gear;

a support member fixed to and extending laterally from the intermediate portion of said drive shaft adjacent said driven gear;

a pivot member fixed to said support member and extending therefrom toward the forward end of said handle member parallel to said drive shaft and spaced apart from said pinion gear and driven gear;

externally-toothed first and second transfer gears connected for rotation together about a common axis, rotatably mounted on said pivot member with said first transfer gear permanently meshed with said pinion gear and said second transfer gear permanently meshed with said driven gear;

said pinion gear, first and second transfer gears and driven gear having respective pitch diameters defining reduction gearing arranged such that for each 360-degree rotation of said handle member said drive shaft is rotated less than 360 degrees;

lock means secured to said handle member operable between an engaged position that prevents rotation of said handle member relative to said drive shaft and as a result said reduction gearing is bypassed and said drive shaft turns the same number of degrees as said handle member with equal torque, and a disengaged position that permits rotation of said handle member relative to said drive shaft and as a result said reduction gearing is operative and said drive shaft turns a lesser number of degrees than said handle member with correspondingly increased torque.

2. A two-speed reduction geared screwdriver, comprising:

a single drive shaft having a forward portion, an intermediate portion and a rearward portion having a common longitudinal axis;

said forward portion of said drive shaft having a free end adapted to engage the head of a screw for turning same;

a single handle member having opposed forward and rearward ends, said handle member provided with a bore open at the forward end of said handle member and extending inwardly therefrom toward the rearward end of said handle member;

a tubular externally-toothed pinion gear fixed to and projecting from the forward end of said handle member coaxial with said bore;

said handle member and pinion gear being rotatably mounted on the rearward portion of said drive shaft for rotation about said longitudinal axis with the forward and intermediate portions of said drive shaft projecting from said pinion gear;

means rotatably securing the rearward portion of said drive shaft in said handle member;

an externally-toothed driven gear fixed coaxially to the intermediate portion of said drive shaft adjacent said pinion gear;

a lug member fixed at one end to and extending laterally from the intermediate portion of said drive shaft adjacent said driven gear and having a free end projecting radially outwardly of said driven gear and pinion gear;

a pivot member fixed to said lug member and extending therefrom toward end of said handle member parallel to said drive shaft and spaced apart from said pinion gear and driven gear;

externally-toothed first and second transfer gears connected for rotation together about a common axis, rotatably mounted on said pivot member with said first transfer gear permanently meshed with said pinion gear and said second transfer gear permanently meshed with said driven gear;

said pinion gear, first and second transfer gears and driven gear having respective pitch diameters defining reduction gearing arranged such that for each 360-degree rotation of said handle member said drive shaft is rotated less than 360 degrees;

lock means secured to said handle member operable between an engaged position that prevents rotation of said handle member relative to said drive shaft and as a result said reduction gearing is bypassed and said drive shaft turns the same number of degrees as said handle member with equal torque, and a disengaged position that permits rotation of said handle member relative to said drive shaft and as a result said reduction gearing is operative and said drive shaft turns a lesser number of degrees than said handle member with correspondingly increased torque.

3. A two-speed reduction geared screwdriver, comprising:

a single drive shaft having a forward portion, an intermediate portion and a rearward portion having a common longitudinal axis;

said forward portion of said drive shaft having a free end adapted to engage the head of a screw for turning same;

a single solid handle member having opposed forward and rearward ends, said handle member provided with a bore open at the forward end of said handle member and extending inwardly therefrom toward the rearward end of said handle member;

a tubular externally-toothed pinion gear fixed to and projecting from the forward end of said handle member coaxial with said bore;

said handle member and pinion gear being rotatably mounted on the rearward portion of said drive shaft for rotation about said longitudinal axis with the forward and intermediate portions of said drive shaft projecting from said pinion gear;

means rotatably securing the rearward portion of said drive shaft in said handle member;

an externally-toothed driven gear fixed coaxially to the intermediate portion of said drive shaft adjacent said pinion gear;

a lug member fixed at one end to and extending laterally from the intermediate portion of said drive shaft adjacent said driven gear and having a free end projecting radially outwardly of said driven gear and pinion gear;

a pivot member fixed to said lug member and extending therefrom toward the forward end of said handle member parallel to said drive shaft and spaced apart from said pinion gear and driven gear;

externally-toothed first and second transfer gears connected for rotation together about a common axis, rotatably mounted on said pivot member with said first transfer gear permanently meshed with said pinion gear and said second transfer gear permanently meshed with said driven gear;

said pinion gear, first and second transfer gears and driven gear having respective pitch diameters defining reduction gearing arranged such that for each 360-degree rotation of said handle member said drive shaft is rotated less than 360 degrees;

said handle member provided with a tubular slot extending crosswise through said handle member centered on a cross-sectional axis orthogonal to said longitudinal axis, said slot being open at opposed outer surfaces of said handle member;

a lock member frictionally slidably mounted in said slot and having opposed ends which are accessible at said opposed outer surfaces for sliding said lock member alternately in opposite directions within said slot, said lock member having a central portion adapted to selectively engage and disengage a segment of said drive shaft, such that, in one position of said lock member said handle member is locked to said drive shaft and as a result said reduction gearing is bypassed and said drive shaft turns the same number of degrees as said handle member with equal torque, and in an alternate position of said lock member said handle member is rotatable relative to said drive shaft and as a result said reduction gearing is operative and said drive shaft turns a lesser number of degrees than said handle member with correspondingly increased torque.

4. A screwdriver as recited in claim 3 wherein said bore terminates short of the rearward end of said handle member and said means rotatably securing the rearward portion of said drive shaft in said handle member comprises:

said rearward portion of said drive shaft having a rearward end portion provided with an annular indentation;

a cylindrical retaining ring defining a resiliently compressible open loop having an outwardly turned edge adapted to jam in said bore, rotatably mounted in said indentation with said edge positioned facing toward the intermediate portion of said drive shaft and initially projecting outwardly of said indentation but compressible into said indentation during insertion of said rearward end portion through said pinion gear into said bore, said drive shaft being rotatably secured in said handle member by means of said edge jamming in said bore.

5. A two-speed reduction geared screwdriver, comprising:

a single drive shaft having a forward portion, an intermediate portion and a rearward portion having a common longitudinal axis;

said forward portion of said drive shaft having a free end adapted to engage the head of a screw for turning same;

an elongate, one-piece, solid, cast plastic handle member having opposed forward and rearward ends, a rearward portion adjacent said rearward end suitable for grasping in the palm of one hand and a forward portion adjacent said forward end having opposed outer surfaces suitable for grasping between the thumb and forefinger of said hand;

said handle member provided with a bore open at the forward end of said handle member, extending inwardly therefrom toward but terminating short of the rearward end of said handle member;

a tubular externally-toothed pinion gear permanently partially embedded in and projecting from the forward end of said handle member coaxial with said bore;

said handle member and pinion gear being rotatably mounted on the rearward portion of said drive shaft for rotation about said longitudinal axis with the forward and intermediate portions of said drive shaft projecting from said pinion gear;

an externally-toothed driven gear permanently fixed coaxially to the intermediate portion of said drive shaft adjacent said pinion gear;

a lug member having one end permanently fixed to said intermediate portion of said drive shaft adjacent said driven gear, extending laterally therefrom and having a free end projecting radially outwardly of said driven gear and pinion gear;

a pivot member fixed to the free end of said lug member and extending therefrom toward the forward end of said handle member parallel to said drive shaft and spaced apart from said pinion gear and driven gear;

externally-toothed first and second transfer gears permanently fixed together for rotation about a common axis, rotatably mounted on said pivot member with said first transfer gear permanently meshed with said pinion gear and said second transfer gear permanently meshed with said driven gear;

said pinion gear, first and second transfer gears and driven gear having respective pitch diameters defining reduction gearing arranged such that for each 360-degree rotation of said handle member said drive shaft is rotated less than 360 degrees;

the forward portion of said handle member provided with a tubular slot extending crosswise therethrough centered on a cross-sectional axis orthogonal to said longitudinal axis, said slot being open at said opposed outer surfaces;

a planar lock member stamped from sheet metal, frictionally slidably mounted in said slot and having opposed ends which are accessible at said opposed outer surfaces for grasping between said thumb and forefinger to slide said lock member alternately in opposite directions within said slot, said lock member having a central portion perpendicularly intersected by said longitudinal axis, said central portion provided with an orifice centered on said longitudinal axis, said lock member being installed in said handle member by first sliding said lock member into said slot and then passing the rearward portion of said drive shaft through said pinion gear and said orifice into said bore, a segment of the rearward portion of said drive shaft being then located within said orifice, said orifice being large enough as measured along said cross-sectional axis to permit sliding said lock member in said opposite directions relative to said segment, said lock member provided with a tab member projecting inwardly from one end of said orifice, said segment provided with a recess adapted to receive said tab member when said lock member is moved in one direction and by such receipt prevent rotation of said handle member relative to said drive shaft so that torque applied to said handle member is transmitted directly to said drive shaft, by movement of said lock member in its opposite direction said tab member being withdrawn from said recess and said handle member being rotatable relative to said drive shaft so that torque applied to said handle member is transmitted through said reduction gearing and said drive shaft thereby turns with correspondingly increased torque;

said rearward portion of said drive shaft having a rearward end portion provided with an annular indentation;

a cylindrical retaining ring defining a resiliently compressible open loop having an outwardly turned edge adapted to jam in said bore, rotatably mounted in said indentation with said edge positioned facing toward the intermediate portion of said drive shaft and initially projecting outwardly of said indentation but compressible into said indentation during insertion of said rearward end portion through said pinion gear and lock member orifice into said bore, said drive shaft being rotatably secured in said handle member by means of said edge jamming in said bore.

6. A two-speed reduction geared screwdriver handle device for use with a detachable screwdriver bit that is adapted to engage the head of a screw for turning same; said screwdriver handle device comprising:

a single drive shaft having a forward portion, an intermediate portion and a rearward portion having a common longitudinal axis;

said forward portion of said drive shaft being adapted to detachably engage said screwdriver bit for turning same;

a single handle member having opposed forward and rearward ends, said handle member provided with a bore open at the forward end of said handle member and extending inwardly therefrom toward the rearward end of said handle member;

a tubular externally-toothed pinion gear fixed to and projecting from the forward end of said handle member coaxial with said bore;

said handle member and pinion gear being rotatably mounted on the rearward portion of said drive shaft for rotation about said longitudinal axis with the forward and intermediate portions of said drive shaft projecting from said pinion gear;

means rotatably securing the rearward portion of said drive shaft in said handle member;

an externally-toothed driven gear fixed coaxially to the intermediate portion of said drive shaft adjacent said pinion gear;

a support member fixed to and extending laterally from the intermediate portion of said drive shaft adjacent said driven gear;

a pivot member fixed to said support member and extending therefrom toward the forward end of said handle member parallel to said drive shaft and spaced apart from said pinion gear and driven gear;

externally-toothed first and second transfer gears connected for rotation together about a common axis, rotatably mounted on said pivot member with said first transfer gear permanently meshed with said pinion gear and said second transfer gear permanently meshed with said driven gear;

said pinion gear, first and second transfer gears and driven gear having respective pitch diameters defining reduction gearing arranged such that for each 360-degree rotation of said handle member said drive shaft is rotated less than 360 degrees;

lock means secured to said handle member operable between an engaged position that prevents rotation of said handle member relative to said drive shaft and as a result said reduction gearing is bypassed and said drive shaft turns the same number of degrees as said handle member with equal torque, and a disengaged position that permits rotation of said handle member relative to said drive shaft and as a result said reduction gearing is operative and said drive shaft turns a lesser number of degrees than said handle member with correspondingly increased torque.

7. A two-speed reduction geared screwdriver handle device for use with a detachable screwdriver bit that is adapted to engage the head of a screw for turning same; said screwdriver handle device comprising:

a single drive shaft having a forward portion, an intermediate portion and a rearward portion having a common longitudinal axis;

said forward portion of said drive shaft being adapted to detachably engage said screwdriver bit for turning same;

a single handle member having opposed forward and rearward ends, said handle member provided with a bore open at the forward end of said handle member and extending inwardly therefrom toward the rearward end of said handle member;

a tubular externally-toothed pinion gear fixed to and projecting from the forward end of said handle member coaxial with said bore;

said handle member and pinion gear being rotatably mounted on the rearward portion of said drive shaft for rotation about said longitudinal axis with the forward and intermediate portions of said drive shaft projecting from said pinion gear;

means rotatably securing the rearward portion of said drive shaft in said handle member;

an externally-toothed driven gear fixed coaxially to the intermediate portion of said drive shaft adjacent said pinion gear;

a lug member fixed at one end to and extending laterally from the intermediate portion of said drive shaft adjacent said driven gear and having a free end projecting radially outwardly of said driven gear and pinion gear;

a pivot member fixed to said lug member and extending therefrom toward the forward end of said handle member parallel to said drive shaft and spaced apart from said pinion gear and driven gear;

externally-toothed first and second transfer gears connected for rotation together about a common axis, rotatably mounted on said pivot member with said first transfer gear permanently meshed with said pinion gear and said second transfer gear permanently meshed with said driven gear;

said pinion gear, first and second transfer gears and driven gear having respective pitch diameters defining reduction gearing arranged such that for each 360-degree rotation of said handle member said drive shaft is rotated less than 360 degrees;

lock means secured to said handle member operable between an engaged position that prevents rotation of said handle member relative to said drive shaft and as a result said reduction gearing is bypassed and said drive shaft turns the same number of degrees as said handle member with equal torque, and a disengaged position that permits rotation of said handle member relative to said drive shaft and as a result said reduction gearing is operative and said drive shaft turns a lesser number of degrees than said handle member with correspondingly increased torque.

8. A two-speed reduction geared screwdriver handle device for use with a detachable screwdriver bit that is adapted to engage the head of a screw for turning same; said screwdriver handle device comprising:

a single drive shaft having a forward portion, an intermediate portion and a rearward portion having a common longitudinal axis;

said forward portion of said drive shaft being adapted to detachably engage said screwdriver bit for turning same;

a single solid handle member having opposed forward and rearward ends, said handle member provided with a bore open at the forward end of said handle member and extending inwardly therefrom toward the rearward end of said handle member;

a tubular externally-toothed pinion gear fixed to and projecting from the forward end of said handle member coaxial with said bore;

said handle member and pinion gear being rotatably mounted on the rearward portion of said drive shaft for rotation about said longitudinal axis with the forward and intermediate portions of said drive shaft projecting from said pinion gear;

means rotatably securing the rearward portion of said drive shaft in said handle member;

an externally-toothed driven gear fixed coaxially to the intermediate portion of said drive shaft adjacent said pinion gear;

a lug member fixed at one end to and extending laterally from the intermediate portion of said drive shaft adjacent said driven gear and having a free end projecting radially outwardly of said driven gear and pinion gear;

a pivot member fixed to said lug member and extending therefrom toward the forward end of said handle member parallel to said drive shaft and spaced apart from said pinion gear and driven gear;

externally-toothed first and second transfer gears connected for rotation together about a common axis, rotatably mounted on said pivot member with said first transfer gear permanently meshed with said pinion gear and said second transfer gear permanently meshed with said driven gear;

said pinion gear, first and second transfer gears and driven gear having respective pitch diameters defining reduction gearing arranged such that for each 360-degree rotation of said handle member said drive shaft is rotated less than 360 degrees;

said handle member provided with a tubular slot extending crosswise through said handle member centered on a cross-sectional axis orthogonal to said longitudinal axis, said slot being open at opposed outer surfaces of said handle member;

a lock member frictionally slidably mounted in said slot and having opposed ends which are accessible at said opposed outer surfaces for sliding said lock member alternately in opposite directions within said slot, said lock member having a central portion adapted to selectively engage and disengage a segment of said drive shaft, such that, in one position of said lock member said handle member is locked to said drive shaft and as a result said reduction gearing is bypassed and said drive shaft turns the same number of degrees as said handle member with equal torque, and in an alternate position of said lock member said handle member is rotatable relative to said drive shaft and as a result said reduction gearing is operative and said drive shaft turns a lesser number of degrees than said handle member with correspondingly increased torque.

9. A screwdriver handle device as recited in claim 8 wherein said bore terminates short of the rearward end of said handle member and said means rotatably securing the rearward portion of said drive shaft in said handle member comprises:

said rearward portion of said drive shaft having a rearward end portion provided with an annular indentation;

a cylindrical retaining ring defining a resiliently compressible open loop having an outwardly turned edge adapted to jam in said bore, rotatably mounted in said indentation with said edge positioned facing toward the intermediate portion of said drive shaft and initially projecting outwardly of said indentation but compressible into said indentation during insertion of said rearward end portion through said pinion gear into said bore, said drive shaft being rotatably secured in said handle member by means of said edge jamming in said bore.

10. A two-speed reduction geared screwdriver handle device for use with a detachable screwdriver bit that is adapted to engage the head of a screw for turning same; said screwdriver handle device comprising:

a single drive shaft having a forward portion, an intermediate portion and a rearward portion having a common longitudinal axis;

said forward portion of said drive shaft being adapted to detachably engage said screwdriver bit for turning same;

an elongate, one-piece, solid, cast plastic handle member having opposed forward and rearward ends, a rearward portion adjacent said rearward end suitable for grasping in the palm of one hand and a forward portion adjacent said forward end having opposed outer surfaces suitable for grasping between the thumb and forefinger of said hand;

said handle member provided with a bore open at the forward end of said handle member, extending inwardly therefrom toward but terminating short of the rearward end of said handle member;

a tubular externally-toothed pinion gear permanently partially embedded in and projecting from the forward end of said handle member coaxial with said bore;

said handle member and pinion gear being rotatably mounted on the rearward portion of said drive shaft for rotation about said longitudinal axis with the forward and intermediate portions of said drive shaft projecting from said pinion gear;

an externally-toothed driven gear permanently fixed coaxially to the intermediate portion of said drive shaft adjacent said pinion gear;

a lug member having one end permanently fixed to said intermediate portion of said drive shaft adjacent said driven gear, extending laterally therefrom and having a free end projecting radially outwardly of said driven gear and pinion gear;

a pivot member fixed to the free end of said lug member and extending therefrom toward the forward end of said handle member parallel to said drive shaft and spaced apart from said pinion gear and driven gear;

externally-toothed first and second transfer gears permanently fixed together for rotation about a common axis, rotatably mounted on said pivot member with said first transfer gear permanently meshed with said pinion gear and said second transfer gear permanently meshed with said driven gear;

said pinion gear, first and second transfer gears and driven gear having respective pitch diameters defining reduction gearing arranged such that for each 360-degree rotation of said handle member said drive shaft is rotated less than 360 degrees;

the forward portion of said handle member provided with a tubular slot extending crosswise therethrough centered on a cross-sectional axis orthogonal to said longitudinal axis, said slot being open at said opposed outer surfaces;

a planar lock member stamped from sheet metal, frictionally slidably mounted in said slot and having opposed ends which are accessible at said opposed outer surfaces for grasping between said thumb and forefinger to slide said lock member alternately in opposite directions within said slot, said lock member having a central portion perpendicularly intersected by said longitudinal axis, said central portion provided with an orifice centered on said longitudinal axis, said lock member being installed in said handle member by first sliding said lock member into said slot and then passing the rearward portion of said drive shaft through said pinion gear and said orifice into said bore, a segment of the rearward portion of said drive shaft being then located within said orifice, said orifice being large enough as measured along said cross-sectional axis to permit sliding said lock member in said opposite directions relative to said segment, said lock member provided with a tab member projecting inwardly from one end of said orifice, said segment provided with a recess adapted to receive said tab member when said lock member is moved in one direction and by such receipt prevent rotation of said handle member relative to said drive shaft so that torque applied to said handle member is transmitted directly to said drive shaft, by movement of said lock member in its opposite direction said tab member being withdrawn from said recess and said handle member being rotatable relative to said drive shaft so that torque applied to said handle member is transmitted through said reduction gearing and said drive shaft thereby turns with correspondingly increased torque;

said rearward portion of said drive shaft having a rearward end portion provided with an annular indentation;

a cylindrical retaining ring defining a resiliently compressible open loop having an outwardly turned edge adapted to jam in said bore, rotatably mounted in said indentation with said edge positioned facing toward the intermediate portion of said drive shaft and initially projecting outwardly of said indentation but compressible into said indentation during insertion of said rearward end portion through said pinion gear and lock member orifice into said bore, said drive shaft being rotatably secured in said handle member by means of said edge jamming in said bore.

* * * * *